United States Patent [19]

Chavis et al.

[11] 4,340,885

[45] Jul. 20, 1982

[54] GAS DETECTOR

[75] Inventors: Leon A. Chavis, San Francisco, Calif.; Gordon P. Moseley, Carson City, Nev.

[73] Assignee: Super Shops, Inc., Newport Beach, Calif.

[21] Appl. No.: 78,608

[22] Filed: Sep. 24, 1979

[51] Int. Cl.[3] ..... G08B 17/10

[52] U.S. Cl. ..... 340/632; 73/23

[58] Field of Search ..... 340/632, 633, 634, 518, 340/332; 422/94, 95, 96, 97; 73/23, 27 R

[56] References Cited

U.S. PATENT DOCUMENTS 3,893,092 7/1975 Kessler ..... 340/332 X 3,938,075 2/1976 Reddy ..... 340/633 X

*Primary Examiner*—John W. Caldwell, Sr.

*Assistant Examiner*—Daniel Myer

[57] ABSTRACT

A gas detector having the features of defective sensor indication, different alarm signals for higher and lower dangerous gas levels, and an away alarm to indicate that an alarm has been activated but that the dangerous gas has by now dissipated.

147 Claims, 4 Drawing Figures

GAS DETECTOR

The present invention provides an improved detector for many different gases for many uses. More specifically, the invention is responsive to hydrogen, propane, butane, methane, gasoline, alcohol and other hydrocarbons. It is particularly suitable for use in boats, homes, recreational vehicles and businesses, by way of example. Further, the invention provides a relatively low cost device of the character described.

The invention includes various combinations of an audio device, a beeper, and four light emitting diodes (LEDs) in four different colors, various ones and combinations of which indicate different danger levels and different conditions.

The circuit is built with solid state electronic components, thus providing high reliability and lightweight coupled with fast speed, low cost and relatively small physical size.

An important step forward over the prior art has to do with the invention's means for automatic base line updating. To this end, the circuit includes a sample, track and store means. This includes means to correct for different environments which might impact differently on the sensor. For example, the same sensor might respond differently in a dry desert climate than it would in a more humid environment. Further, as the device is moved about, as in use in vehicles, this base line updating occurs on a continuous basis. The base line updating is coupled with other means providing a maximum high limit so that the instrument cannot calibrate itself away from a dangerous situation.

Another feature of the invention is an "away alarm". The invention will indicate to a user who has left the premises secured by the invention that in his absence there has been a dangerous gas concentration which is not now present. This is a feature that has not been found in the prior art at all.

The solid state circuitry includes a "clock" which produces fiducial pulses at a regular although adjustable time interval. Many other parts of the circuitry and the device operate off of these clock pulses, including the automatic base line updating which determines the frequency at which updates are made, flashing of the lights in the various alarm modes, and permitting a low cost steady tone device to operate in an on/off beeping mode, which is, in addition to its cost savings, more attention demanding.

Yet another feature is means included in the circuit to detect and alarm for a defective sensor. This feature is not generally present in the prior art.

Yet another feature is the inclusion of a high limit alarm which does not update, and which further can come on immediately after the 30 second reset period, so that the device is "ever vigilent" and will respond to a gas presence even if it should occur during the short time period when the detector is being reset.

Yet another advantage and feature is the inclusion of both a built-in sensor and a remote sensor which can be on a cable and moved to different positions within the space being secured. Further, the invention is adaptable to use with sensors of various different sorts, although a chemical type sensor is preferred.

Another advantage is the use of the four LEDs and the audio device in different combinations to alert to many different conditions, and to do so in a logical order of increasingly dangerous levels of gas detected.

The above and other advantages of the invention will be pointed out or will become evident in the following detailed description and claims, and in the accompanying drawings also forming a part of the disclosure, in which:

Figure 1:
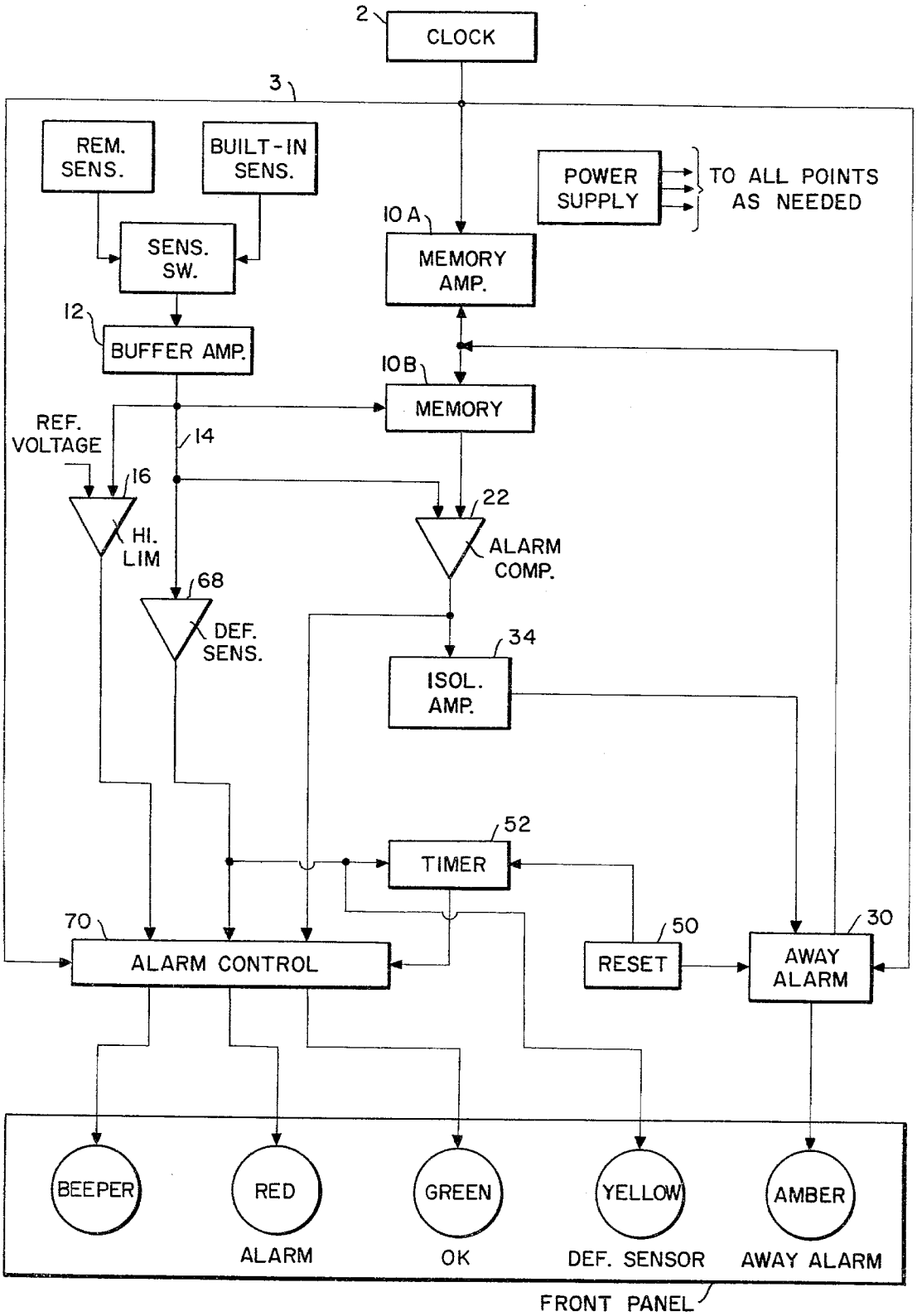
FIG. 1 is an overall schematic diagram of the invention.

Referring now to FIG. 1 and starting in the upper left hand corner, the invention includes both a remote sensor and a built-in sensor which operate through a sensor switch and feed a signal to a buffer amplifier 12. The array of the two sensors and the switch are analogous to a tape recorder or a television set wherein plugging in a remote automatically disables the built-in microphone or speaker. Alternatively, as will be evident to those skilled in these arts, the capability of operating off both a remote and a built-in sensor could be provided, changes being made to the circuit as required.

The amplifier 12 itself is conventional, and is needed to isolate the remaining circuitry from the sensors or sensor in use. The invention is capable of use with various different sensors. A chemical type device known as a Model 813 made by Figaro of Japan was used in the successfully constructed embodiment. The output of buffer 12 is on a line 14 having various branches going to other parts of the circuitry. The voltage on line 14 is directly proportional to the amount of gas sensed by whatever sensor is in use. That is, the greater the gas concentration the higher the voltage on line 14. Further, because of the isolation or buffer amplifier 12, this voltage is proportional solely to gas sensed and is isolated and protected from other outside influences.

An advantage of the particular sensor used is that it has a wide range of responsiveness, that is, it will respond to many different potentially dangerous or explosive gases. These include hydrocarbons such as propane, butane, methane, gasoline, and alcohol, hydrogen, as well as other gases. Further, it will detect and produce operative voltages at between 10 and 20% of the lower explosive limit for propane, butane, methane and gasoline. It is a relatively low priced and highly reliable element, operating on a chemical principle.

Its only disadvantage is that it requires about a minute and a half to two minutes to warm up before it is ready to operate. The green LED marked "OK" at the bottom of FIG. 1 on the front panel is indicative of the ready to operate condition of the sensor.

Another advantageous feature of this particular sensor is that when it fails it produces no output voltage. This condition is detected and is used as set forth below to operate the yellow LED marked "Def. Sensor", which indicates to the user that the sensor must be replaced.

Referring now to the upper right hand corner of FIG. 1, the invention circuit includes a power supply which supplies current as needed throughout the remainder of the circuit. Any conventional power supply can be used with the invention, particular voltages and currents supplied being dependent upon the particular circuitry and components.

Referring to the center portion of the upper part of FIG. 1, the invention circuit includes a conventional "clock" element 2 which outputs regular fiducial pulses at a predetermined frequency on a multi-branched clock pulse line 3. Element 2 includes internal means to adjust the output frequency.

The invention provides means to correct for the ambient atmosphere, that is for example to correct the sensor for operation in a dry climate as opposed to a humid climate. These means also automatically accomodate the varying condition of the sensor itself as it ages in use. Further, this same portion of the invention comprises means to continuously during operation detect slow drifts in the background or ambient conditions, and to automatically accomodate for them. This drift correction is also caused to be speed responsive, so that in the event of a relatively rapid change in gases detectable in the air, even though the new level is below the absolute maximum, still the device will alarm. This portion of the circuit also includes a time filter (RC), which filters random "spikes" in gas detector voltage, so that the device will not false alarm. All of this is accomplished primarily through the use of a memory or sample, track and store circuit which is made up of the two blocks 10A and 10B, 10A being a more or less conventional memory amplifier, and the block 10B being the memory device of the invention which is shown in more detail in FIG. 2. The sample track and store portion also includes comparator 22 and part of away alarm 30.

These portions, plus the clock pulses on line 3 and the gas proportional voltage on line 14, control the rest of the circuitry.

This modus operandi produces many important advantages including that a single relatively inexpensive multi purpose sensor can be used. The invention automatically accomodates the sensor to the particular environment. Absent this feature, the sensor itself would have to be specially "tailored" to a particular gas or environment, and could not be used in other environments, and would have to be manually or otherwise calibrated or retuned for changed conditions. Thus, the automatic base line updating of the invention is doubly important both from the point of view of operation within the invention circuit, as well as permitting the use of various different sensors in a highly efficient manner.

The automatic base line correction happens on a continual basis as the circuitry tracks gas changes. Below a certain limit base line corrections are made. The system is also speed responsive, that is, it responds to the speed at which the gas concentration increases. This is controlled by the period of the pulses produced from the clock and the adjustment within comparator 22. That is, so long as the amount of increase in concentration between clock pulses is below a certain limit set within the circuitry, then an update will be made and no alarm means will be triggered. If however, the amount of gas increase between clock pulses is greater than this built-in limit, then alarm means will be triggered, and further base line updating will cease to thereby freeze that particular base line.

On the other hand, the possibility of a slow increase in gas concentration at a rate less than this between pulse limit which might otherwise allow the environment controlled by the gas detector to exceed a dangerous level is prevented by an absolute high limit detector 16. This will trigger an alarm if the voltage on line 14, and hence the gas concentration, exceeds a certain predetermined value regardless of the speed at which it is achieved.

The other input to the high limit detector 16 is a reference voltage as indicated, said reference voltage being factory set (or adjustable) and proportioned to some value, say 20% of the explosive limit of the average of the various gases to be detected.

An alarm comparator circuit 22 compares the present base line signal from the memory 10B to the signal corresponding the then detected gas on line 14, and its output is directed to away alarm 30 via isolation amplifier 34, and the alarm circuitry 70, both as described below. Thus, 22 is always comparing the current condition on line 14 to the last base line from 10B.

The memory portion 10B "remembers" the previous reading on line 14, and then sends it on the alarm comparator 22, wherein it is compared to the current reading which is present on line 14. Thus, comparator 22 constantly compares the latest two readings.

Portion 10A is an amplifier and works with the portion 10B as described in detail below in accomplishing its functions.

Isolation amplifier 34 does exactly that function, that is, it separates blocks 22 and 30 from each other and also increases the signal from 22 to drive block 30.

Block 52, called "Timer" provides an enable signal to alarm control 70 to control its operation, as is described in detail below. The time out function allows the time necessary for the sensor to stabilize, which can be from 30 seconds to 2 minutes depending upon the particular sensor in use.

The away alarm 30 stops memory base line updating, and also uses the clock input on line 3 to blink the amber away alarm LED. The input to isolation amplifier 34, which is the output signal from comparator 22, is required so that the memory 10 can be stopped as necessary, as indicated by the line running up from block 30 to memory 10. When a dangerous gas level is detected at the first and lower predetermined level, a signal is output on this line so that the memory will stop updating.

The alarm control 70 receives all the various inputs indicated, and operates the audio beeper, and the red and green LEDs, all as is explained below.

The display or alarm means of the invention include an audio device called the beeper, which is a steady tone device caused to operate by the invention circuit in an intermittent on/off fashion. This permits use of a lower cost component. The alarm means also includes four colored LEDs, red, green, yellow and amber. The yellow LED is used solely to indicate a defective sensor, as explained above. The away alarm amber LED indicates that a dangerous gas condition of some sort existed sometime ago, but has since gone away, if another LED is not also lit. This particular feature, the "away alarm" is an important improvement of the invention, and is not thought to have existed in the prior art heretofore.

The red and green LEDs indicate the remaining alarm conditions. The green light is the first which goes on, and it comes on after the sensor has warmed up and is ready to operate. The beeper accompanies any and all alarm conditions.

If the environment being protected should experience a dangerous gas at a concentration above a first predetermined level, the first alarm condition is alternate red and green flashing accompanied by the beeper. If gas concentration continues to increase, or if at anytime the high limit detector 16 should operate, this will cause the green light to not flash, and will cause the red light to go on steady. The red light steady indicates a higher second predetermined level gas concentration, one exceeding the high limit, and is the more dangerous condition. This is also accompanied by the beeper. The amber away alarm will also flash during this period, and will continue to flash even after the gas level dissipates. Thus, as gas level goes up and then goes down, the following sequence wil occur: (1) green LED, system OK and ready to operate; (2) red and green flashing plus beeper, low level of gas; (3) steady red and beeper, high level of gas and (4) amber flashing and beeper, away alarm; and (5) yellow LED at any time plus beeper, bad sensor.

This sequence 1–4 will occur in reverse as gas dissipates, namely the next occurrence will be: (6) high limit goes out and red and green flash accompanied by beeper; (7) red and green flashing ceases, beeper turns off, and green OK remains on, (8) amber flashing away alarm continues to operate until the device is reset.

Figure 2:
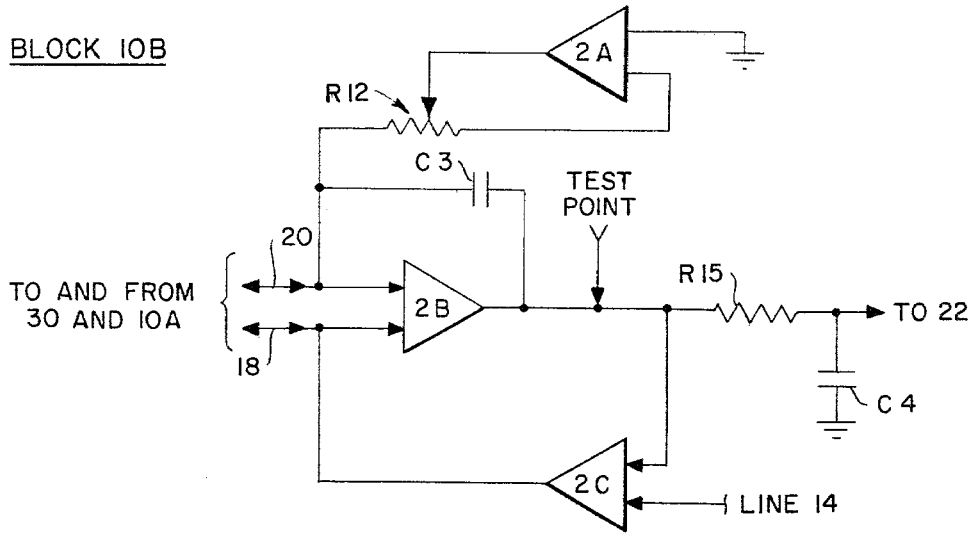
FIGS. 2, 3 and 4 are exploded schematic views of various of the different logic blocks of FIG. 1.

Referring now to FIG. 2, the memory portion 10B is shown in detail. It consists of a capacitor C3, a drift compensating potentiometer R12, and three operational amplifiers 2A, 2B, and 2C on a single, solid state chip. Amplifier 2A provides a constant bias through calibration potentiometer R12 as one of the inputs to element 2B so that amplifier 2B will not drain the charge stored on capacitor C3. The charge on capacitor C3 is the "memory" provided by logic block 10B. The two remaining components 2B and 2C are in a closed loop mode. The inputs to element 2B are the clock pulses, with means not shown provided to input them in opposite polarities. Update signals in the successfully constructed embodiments are made once every second and last for about half a second, and thus the system is updating half the time and "sniffing" for gas half the time. It is essential that the system not lose the memory signal stored on capacitor C3 while it is in its "sniffing" mode. To this end, means not shown in companion memory portion 10A grounds out the output of amplifier 2C on line 18 so that even if the input to element 2B should change, still its output cannot change. An input of amplifier 2C is on line 14 from the sensor.

The symmetrical situation occurs under the control of another means (not shown) of the amplifier portion 10A with respect to the line 20 feeding the other side of element 2B. The voltage corresponding to the base level is stored on capacitor C3 because it, capacitor C3, is in the feedback loop between the two amplifiers 2B and 2C, in parallel circuit.

Thus, it is this combination which permits all of the advantages of the memory or sample track and store feature of the invention.

Figure 3:
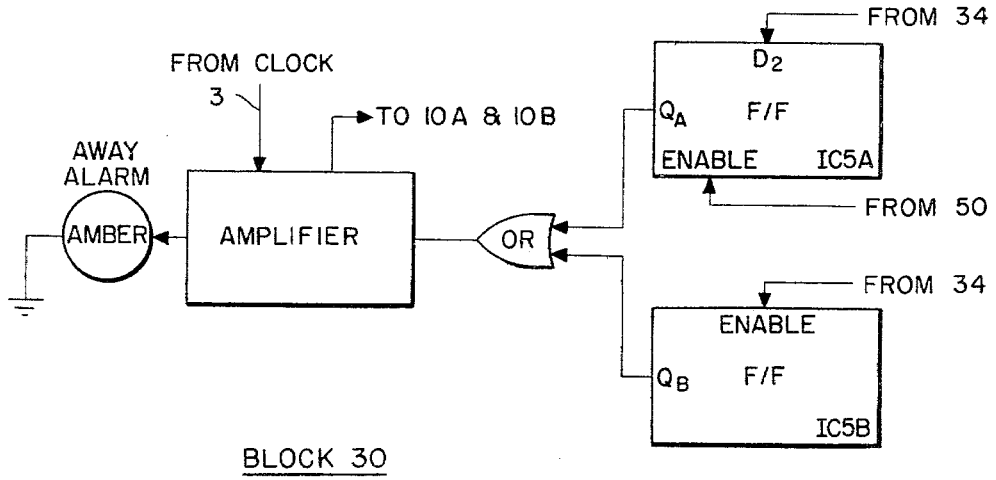

Referring now to FIG. 3, there is shown a blown up view of the logic block 30. Block 30 includes a pair of flip flops IC5A and IC5B, which are both of the D type, the D standing for data. D type flip flops operate, upon receipt of an enable pulse, to move whatever is on its input D2 to its output Q. The outputs $Q_A$ and $Q_B$ of the two flip flops feed into an OR gate. Thus, either output will operate the amplifier, which in turn operates the amber away alarm. Line 3 from the clock also feeds into the amplifier of the circuit which is used in a conventional manner to cause the amber LED to flash when it is activated.

The flip flops in away alarm block 30 serve also to prevent the base line from updating under the control of comparator 22 via amplifier 34. When the comparator 22 compares the previous stored base line signal to the current signal, and if that difference is larger than a predetermined tolerance built into comparator 22, then it causes stopping of further base line updates by working through block 30 to enable one of the flip flops which operates through the amplifier in block 30 to thereby prevent further clock pulses from going to the memory, as shown in FIG. 3.

In block 10B the time delay circuit of R15 and C4 are a minor screen type device. They prevent very small time duration excursions, or "spikes", between the stored value and the current value from causing an alarm. That is, the change has to be sufficiently long in time to overcome that time delay before it will cause an alarm. Absent R15 and C4 the circuit would be overly sensitive.

In operation, the first thing that happens is that the entire circuit is reset by a pulse from reset block 50 into the enable terminal of IC5A. This clears the upper half flip flop, the companion IC5B remaining in its previous state because it is controlled by block 34 from the isolation amplifier which in turn operates from the alarm comparator 22. By having the two flip flops feeding through a single OR gate, the amber light will be operated by either one of the two conditions, namely, a gas alarm under the control of one flip flop in normal operation, or a gas alarm as detected during the reset period. In this manner the system is "ever vigilent", that is, responsive to gas conditions even if they should occur during the time required for resetting or for the sensor to warm up.

The line from the amplifier in block 30 going to the memory disables the memory to stop the clock from updating it after an alarm condition is detected. This occurs by means not shown within the companion block 10A, namely, by stopping the alternating of the clock pulses on lines 18 and 20 into block 10B to thus "freeze" a particular base line on the capacitor C3.

Figure 4:
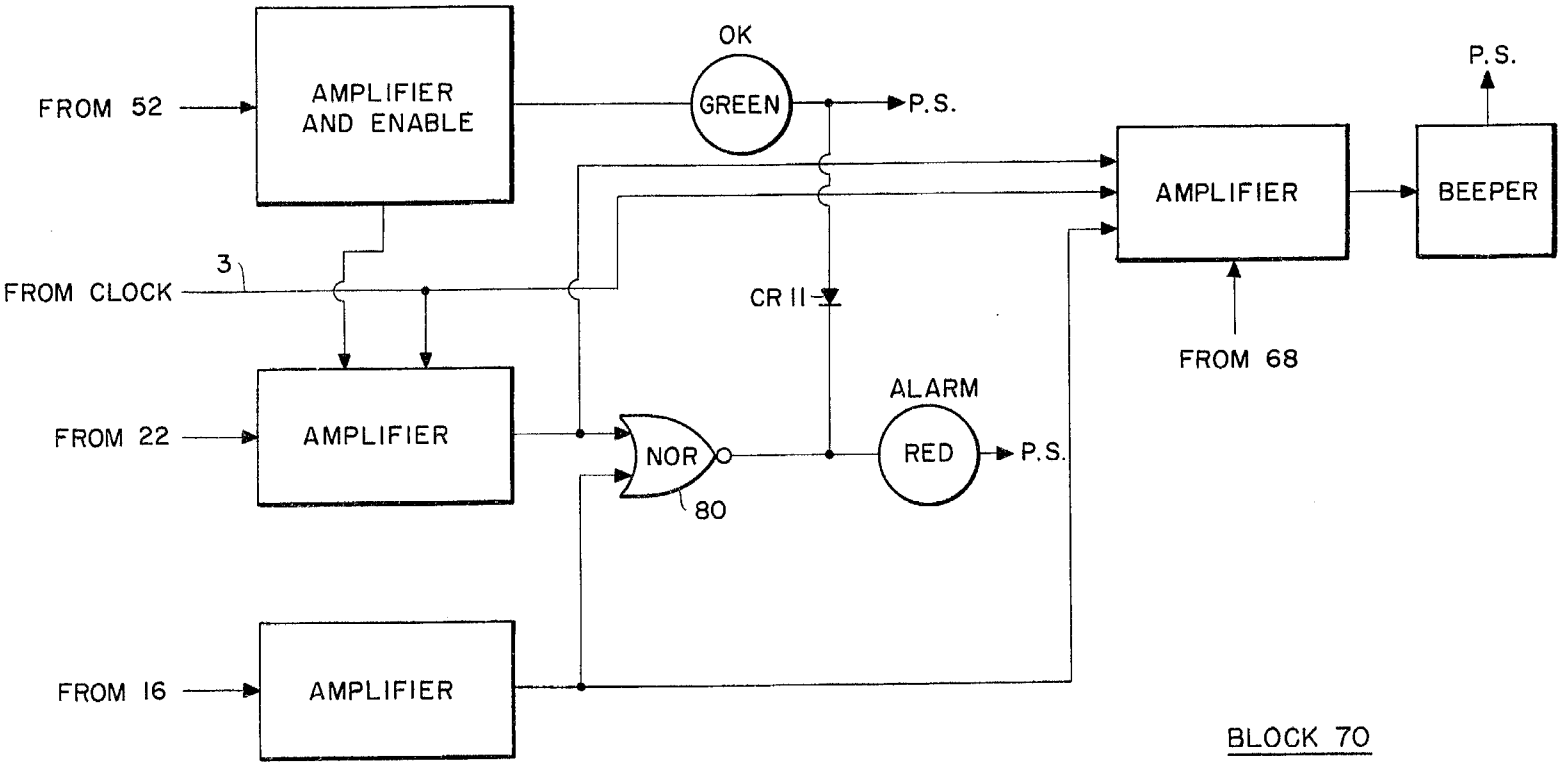

Referring now to the blow up of block 70, the alternate blinking of the red and green LEDs is accomplished primarily through the use of the NOR gate 80 whose inputs are both the clock pulses on line 3, and pulses from the alarm comparator 22 joined together through an amplifier to be one input to the NOR gate. The other input is from high limit comparator 16. This input from 16 will normally be a logic 1 going to a logic 0 only when the high limit is detected, as described below. The NOR gate will only output a 1 when it has two logic 0s as inputs. Blinking occurs through the action of diode CR11. When the red LED goes on it automatically drains the current away from the green LED through CR11 causing the green to go off. The next occurance is a clock pulse on the input to the NOR gate which causes the NOR gate to change state which turns off the red LED which stops the bleeding of the current to the green LED which causes the green to go on again. The next clock pulse reverses back again, and thus alternate blinking of red and green occurs. The legend "P.S." in FIG. 4 indicates the power supply and its controlled grounding which cooperates with the diode CR11 to achieve this modus operandi.

As gas content increases to the second predetermined value, the high or maximum limit, it is desired that the red LED go on steady and the green LED go off. This happens when 16, the high limit comparator, which is normally high goes low. Element 16 is a type of gate in which will produce a logic low when both its inputs are high, which occurs when the gas content rises sufficiently so that the voltage produced matches the reference voltage input to 16. When this occurs the voltage low is delivered to the NOR gate which then disables the clock pulses from causing the red LED to blink causing the red LED to go on steadily. This condition continually bleeds current from the green LED which causes it to remain off.

The beeper is wired into the circuit to accompany all alarm conditions of any kind including defective sensor and high limit.

While the invention has been described in detail above, it is to be understood that this detailed description is by way of example only, and the protection granted is to be limited only within the spirit of the invention and the scope of the following claims.

We claim:

1. An electronic circuit for a gas detector including clock means, said circuit comprising means to sample, track and store signals proportional to gas detected, said clock means controlling the operation of said sample, track and store means, said detector comprising alarm means, and said circuit comprising means to cause said clock means to operate at least a portion of said alarm means in an alternating manner.

2. The combination of claim 1, said detector comprising means to sense gas concentration and to output a signal proportional thereto, said sample, track and store means comprising a closed loop of a pair of amplifiers, one input of one of said amplifiers comprising said signal corresponding to current gas concentration sensed, said second amplifier having a pair of inputs, one of said inputs of said second amplifier comprising the output of said one amplifier together with an enable signal from said clock means, the second input to said second amplifier comprising an enable signal from said clock means together with a signal from said storage means corresponding to the previous stored signal corresponding to the input of said first amplifier, said clock means alternately activating the two inputs to said second amplifier, said storage means also sensing the output of said second amplifier to update itself thereto, said sample track and store means including comparator means for comparing the output of said loop as a base line and the current signal, said comparator means being adapted to output a signal when the comparison result is greater than a predetermined gas presence, and means responsive to said comparator output signal to disable the inputs of said clock means to said second amplifier, whereby said sample track and store means does not permit further base line updating after detection of said predetermined gas presence.

3. The combination of claim 1, said alarm means comprising a plurality of different color light means, said light means comprising a first color for indicating that a predetermined high limit of gas concentration has been detected, said light means comprising a second color, said alternating operating means comprising means to cause said first and second colors to alternately blink for indicating a gas concentration less than said high limit but more than a predetermined lower value, and said light means comprising a third color which when activated alone indicates that a gas concentration of at least said predetermined lower value was detected but has now dissipated.

4. The combination of claim 3, and means for activating one of said colors alone and steadily for indicating that the detector is warmed up and ready to operate.

5. The combination of claim 3, said detector comprising gas sensing means, and said light means comprising a fourth color which when activated indicates that said sensing means is not operating properly.

6. The combination of claim 5 wherein said first color is red, said second color is green, said third color is amber, and said fourth color is yellow.

7. The combination of claim 3, said alarm means further comprising audio means which sound to accompany activation of any of said light means when said light means are activated to indicate an alarm.

8. The combination of claim 7, wherein said first color is red, said second color is green, said third color is amber, and said audio means comprising a beeper which sounds on and off in synchronism with said blinking colors.

9. The combination of claim 3, said predetermined low value comprising a tolerance for gas concentration increase in a selected time period.

10. The combination of claim 3, means to activate said first color steadily to indicate said high limit, said last mentioned means together with said means to blink said first and second colors comprising a NOR gate and a diode so arranged in circuit with clock means that said clock means causes alternate activation of said first and second colors unless a high limit signal is present, and said high limit signal overriding said alternate activation to activate said first color steadily.

11. The combination of claim 1, and sensor means for producing a signal corresponding to gas concentration sensed, said sample track and store means comprising memory means comprising signal storage means arranged to track the gas concentration signal using a feedback loop by periodically sampling said gas concentration signal, means controlled by said clock means to alternately input said stored signal and said sample signal from said gas sensor means into said loop, the output of said loop comprising the base line for the remainder of said circuit, and means to permit only changes between said stored signal and said current signal of more than a predetermined tolerance to cause said base line to stop updating.

12. A combination of claim 11, and said means to cause said base line to stop updating also simultaneously activating said alarm means.

13. The combination of claim 11, said permitting means comprising a comparator which continuously compares the current gas sample signal and the latest base line signal, and said comparator comprising means to set said predetermined tolerance.

14. The combination of claim 11, said tolerance comprising a predetermined increase in gas concentration occurring in less than a predetermined period of time.

15. The combination of claim 11, said clock means operating on a one minute cycle, and wherein said gas signal is tracked for approximately 30 seconds of each cycle.

16. The combination of claim 1, and said alarm means further comprising away alarm means which indicates that a predetermined gas condition has been detected and that the gas has now diminished to less than said predetermined condition.

17. The combination of claim 16, said away alarm means further comprising visual alarm means and audio alarm means which operate simultaneously with said visual alarm means.

18. The combination of claim 17, said audio alarm means comprising a beeper and means to cause said beeper to operate in an on/off means.

19. The combination of claim 18, said beeper operating means comprising clock means in an electronic circuit.

20. The combination of claim 1, said detector comprising gas sensor means, said detector comprising means for producing a signal corresponding to a predetermined limit of gas concentration means to operate said alarm means when the gas sensed is above said predetermined limit, means to reset said detector between periods of operation, and means using said produced signal to immediately operate said alarm means in the event gas sensed should exceed said high limit during the re-setting operation.

21. The combination of claim 20, said alarm means operating means comprising a high limit comparator, and said produced signal comprising a reference voltage.

22. The combination of claim 1, said gas detector comprising gas sensor means, means to reset said detector between periods of operation, means to store a signal corresponding to a sensed gas concentration in said sample track and store means, and means to cause said stored signal to operate said alarm means immediately after the re-setting operation is completed in the event said sensed gas concentration exceeds said predetermined value during the resetting operation.

23. The combination of claim 22, said signal storing means comprising a capacitor, means to isolate said capacitor during the re-setting operation, and said means to cause comprising a comparator which compares said stored signal to a signal corresponding to the current value of sensed gas concentration and which operates said alarm means when the result of said comparison exceeds a predetermined tolerance.

24. The combination of claim 1, said gas detector comprising gas sensing means, said electronic circuit means interconnecting said sensing means and said alarm means, said sample, track and storage means comprising memory means for storing a signal corresponding to a gas concentration detected by said sensing means, means to compare a previously stored signal to a current value of said signal, and means to operate said alarm means if the result of said comparison exceeds a predetermined tolerance.

25. The combination of claim 24, said alarm means comprising light means indicating that the detector is warmed up and ready to operate normally when steadily lit.

26. The combination of claim 24, said alarm means comprising light means indicating that the sensing means in said detector is faulty.

27. The combination of claim 24, said alarm means also comprising audio means which sound together with any of said light means.

28. The combination of claim 24, said detector means comprising means to immediately operate said alarm means in the event gas concentration detected should at any time exceed a predetermined high limit.

29. The combination of claim 1, said detector comprising a built-in gas sensor and a remote sensor, switch means in said detector to permit signals from said built-in sensor to normally operate said detector, and said switch means including means to disable said built-in sensor when said remote sensor is put into operative cooperation with said detector.

30. The combination of claim 29, each of said sensors comprising a chemical based type device which responds to a plurality of different gases.

31. A gas detector comprising alarm means which comprises a plurality of different color light means, said light means comprising a first color for indicating that a predetermined high limit of gas concentration has been detected, said light means comprising a second color, means to cause said first and second colors to alternately blink for indicating a gas concentration less than said high limit but more than a predetermined lower value, and said light means comprising a third color which when activated alone indicates that a gas concentration of at least said predetermined lower value was detected but has now dissipated.

32. The combination of claim 31, and means for activating one of said colors alone and steadily for indicating that the detector is warmed up and ready to operate.

33. The combination of claim 31, said detector comprising gas sensing means, and said light means comprising a fourth color which when activated indicates that said sensing means is not operating properly.

34. The combination of claim 33 wherein said first color is red, said second color is green, said third color is amber, and said fourth color is yellow.

35. The combination of claim 31, said alarm means comprising audio means which sound to accompany activation of any of said light means when said light means are activated to indicate an alarm.

36. The combination of claim 35, wherein said first color is red, said second color is green, said third color is amber, and said audio means comprising a beeper which sounds in synchronism with said blinking colors.

37. The combination of claim 31, said predetermined low value comprising a tolerance for gas concentration increase in a selected time period.

38. The combination of claim 31, means to activate said first color steadily to indicate said high limit, said last mentioned means together with said means to blink said first and second colors comprising a NOR gate and a diode so arranged in circuit with clock means that said clock means causes alternate activation of said first and second colors unless a high limit signal is present, and said high limit signal overriding said alternate activation to activate said first color steadily.

39. The combination of claim 31, said gas detector comprising an electronic circuit comprising sample track and store means and sensor means for producing a signal corresponding to gas concentration sensed, said sample track and store means comprising clock means and memory means, said memory means comprising signal storage means arranged to track the gas concentration signal using a feedback loop by periodically sampling said gas concentration signal, means controlled by said clock means to alternately input said stored signal and said sample signal from said gas sensor means into said loop, the output of said loop comprising the base line for the remainder of said circuit, and means to permit only changes between said stored signal and said current signal of more than a predetermined tolerance to cause said base line to stop updating.

40. A combination of claim 39, and said means to cause said base line to stop updating also acting to simultaneously activate said alarm means.

41. The combination of claim 39, said permitting means comprising a comparator which continuously compares the current gas sample signal and the latest base line signal, and said comparator comprising means to set said predetermined tolerance.

42. The combination of claim 39, said tolerance comprising a predetermined increase in gas concentration occurring in less than a predetermined period of time.

43. The combination of claim 39, said clock means operating on a one minute cycle, and wherein the gas signal is tracked for approximately 30 seconds of each cycle.

44. The combination of claim 31, said third color comprising an away alarm further comprising visual alarm means and audio alarm means which operate simultaneously.

45. The combination of claim 44, said audio alarm means comprising a beeper and means to cause said beeper to operate in an on/off mode.

46. The combination of claim 45, said beeper operating means comprising clock means in an electronic circuit.

47. The combination of claim 31, said detector comprising gas sensor means said detector comprising means for producing a signal corresponding to a predetermined limit of gas concentration, means to operate said alarm means first color when the gas sensed is above said predetermined limit, means to reset said detector between periods of operation, and means using said produced signal to immediately operate said alarm means first color in the event gas sensed should exceed said high limit during the re-setting operation.

48. The combination of claim 47, said alarm means first color operating means comprising a high limit comparator, and said produced signal comprising a reference voltage.

49. The combination of claim 13, said gas detector comprising gas sensor means, means to reset said detector between periods of operation, means to store a signal corresponding to a sensed gas concentration, and means to cause said stored signal to operate appropriate ones of the colors in said alarm means immediately after the re-setting operation is completed in the event said sensed gas concentration exceeds said predetermined limit or value during the resetting operation.

50. The combination of claim 49, said signal storing means comprising a capacitor, means to isolate said capacitor during the re-setting operation, and said means to cause comprising a comparator which compares said stored signal to a signal corresponding to the current value of sensed gas concentration and which operates said blinking first and second colors when the result of said comparison exceeds a predetermined tolerance.

51. The combination of claim 50, said predetermined tolerance comprising a predetermined increase in gas concentration occurring in less than a predetermined time set on said comparator.

52. The combination of claim 31, said detector comprising gas sensing means, electronic circuit means interconnecting said sensing means and said alarm means, said circuit means comprising memory means for storing a signal corresponding to a gas concentration detected by said sensing means, means to compare a previously stored signal to a current value of said signal, and means to operate said alarm means if the result of said comparison exceeds a predetermined tolerance.

53. The combination of claim 52, said detector means comprising means to immediately operate said alarm means first color in the event gas concentration detected should at any time exceed said predetermined high limit.

54. The combination of claim 31, said detector comprising a built-in gas sensor and a remote sensor, switch means in said detector to permit signals from said built-in sensor to normally operate said detector, and said switch means including means to disable said built-in sensor when said remote sensor is put into operative cooperation with said detector.

55. The combination of claim 54, each of said sensors comprising a chemical based type device which responds to a plurality of different gases.

56. A gas detector comprising an electronic circuit comprising sample track and store means and sensing means for producing a signal proportional to gas concentration sensed, said sample track and store means comprising clock means and memory means, said memory means comprising signal storage means arranged to track the gas concentration signal using a feedback loop by periodically sampling said gas concentration signal, means controlled by a clock means to alternately input said stored signal and a current sample signal from said gas sensor means into said loop, the output signal of said loop comprising the base line for the remainder of said circuit, and means to permit only a change between said stored signal and said current sample signal of more than a predetermined tolerance to cause said base line to stop updating.

57. A combination of claim 56, said detector comprising alarm means, and said means to cause said base line to stop updating also acting to simultaneously activate said alarm means.

58. The combination of claim 56, said permitting means comprising a comparator which continuously compares the current gas sample signal and the latest base line signal, and said comparator comprising means to set said predetermined tolerance.

59. The combination of claim 56, said clock means operating on a one minute cycle, and wherein the gas signal is tracked for approximately 30 seconds of each cycle.

60. The combination of claim 56, said tolerance comprising a predetermined increase in gas concentration occurring in less than a predetermined period of time.

61. The combination of claim 56, said detector comprising away alarm means which indicates that a predetermined gas condition has been detected and that the gas has now diminished to less than said predetermined condition.

62. The combination of claim 61, said away alarm means further comprising visual alarm means and audio alarm means which operate simultaneously with said visual alarm means.

63. The combination of claim 62, said audio alarm means comprising a beeper and means to cause said beeper to operate in an on/off mode.

64. The combination of claim 62, said beeper operating means comprising said clock means.

65. The combination of claim 56, said detector comprising alarm means, said detector comprising means for producing a signal corresponding to a predetermined high limit of gas concentration means to operate said alarm means when the gas sensed is above said predetermined limit, means to reset said detector between periods of operation, and means using said produced signal to immediately operate said alarm means in the event gas sensed should exceed said high limit during the re-setting operation.

66. The combination of claim 65, said alarm means operating means comprising a high limit comparator, and said produced signal comprising a reference voltage.

67. The combination of claim 56, said gas detector comprising alarm means, means to reset said detector between periods of operation, means to store a signal corresponding to a sensed gas concentration, and means to cause said stored signal to operate said alarm means immediately after the re-setting operation is completed in the event said sensed gas concentration exceeds said predetermined value during the resetting operation.

68. The combination of claim 67, said signal storing means comprising a capacitor, means to isolate said capacitor during the re-setting operation, and said means to cause comprising a comparator which compares said stored signal to a signal corresponding to the current value of sensed gas concentration and which operates said alarm means when the result of said comparison exceeds a predetermined tolerance.

69. The combination of claim 56, said detector comprising alarm means, electronic circuit means interconnecting said sensing means and said alarm means, said memory means storing a signal corresponding to a gas concentration detected by said sensing means, means to compare a previously stored signal to a current value of said signal, and means to operate said alarm means if the result of said comparison exceeds a predetermined tolerance.

70. The combination of claim 69, said alarm means comprising light means indicating that the detector is warmed up and ready to operate normally when steadily lit.

71. The combination of claim 69, said alarm means comprising light means indicating that the sensing means in said detector is faulty.

72. The combination of claim 69, said alarm means also comprising audio means which sound together with any of said light means.

73. The combination of claim 69, said detector means comprising means to immediately operate said alarm means in the event gas concentration detected should at any time exceed a predetermined high limit.

74. The combination of claim 56, said sensing means comprising a built-in gas sensor and a remote sensor, switch means in said detector to permit signals from said built-in sensor to normally operate said detector, and said switch means including means to disable said built-in sensor when said remote sensor is put into operative cooperation with said detector.

75. The combination of claim 74, each of said sensors comprising a chemical based type device which responds to a plurality of different gases.

76. A gas detector comprising away alarm means which indicates that a predetermined gas condition has been detected and that the gas has now diminished to less than said predetermined condition.

77. The combination of claim 76, said away alarm means further comprising visual alarm means and audio alarm means which operate simultaneously with said visual alarm means.

78. The combination of claim 77, said audio alarm means comprising a beeper and means to cause said beeper to operate in an on/off mode.

79. The combination of claim 77, said beeper operating means comprising clock means in an electronic circuit.

80. The combination of claim 76, said detector comprising gas sensor means and alarm means, said alarm means including said away alarm means, said detector comprising means for producing a signal corresponding to a predetermined limit of gas concentration means to operate said alarm means when the gas sensed is above said predetermined limit, means to reset said detector between periods of operation, and means using said produced signal to immediately operate said alarm means in the event gas sensed should exceed said high limit during the re-setting operation.

81. The combination of claim 80, said alarm means operating means comprising a high limit comparator, and said produced signal comprising a reference voltage.

82. The combination of claim 76, said gas detector comprising gas sensor means and alarm means, said alarm means including said away alarm means, means to reset said detector between periods of operation, means to store a signal corresponding to a sensed gas concentration, and means to cause said stored signal to operate said alarm means immediately after the re-setting operation is completed in the event said sensed gas concentration exceeds said predetermined value during the resetting operation.

83. The combination of claim 82, said signal storing means comprising a capacitor, means to isolate said capacitor during the re-setting operation, and said means to cause comprising a comparator which compares said stored signal to a signal corresponding to the current value of sensed gas concentration and which operates said alarm means when the result of said comparison exceeds a predetermined tolerance.

84. The combination of claim 76, said detector comprising gas sensing means and alarm means, said alarm means including said away alarm means, electronic circuit means interconnecting said sensing means and said alarm means, said circuit means comprising memory means for storing a signal corresponding to a gas concentration detected by said sensing means, means to compare a previously stored signal to a current value of said signal, and means to operate said alarm means if the result of said comparison exceeds a predetermined tolerance.

85. The combination of claim 84, said alarm means comprising light means indicating that the detector is warmed up and ready to operate normally when steadily lit.

86. The combination of claim 84, said alarm means comprising light means indicating that the sensing means in said detector is faulty.

87. The combination of claim 84, said alarm means also comprising audio means which sound together with any of said light means.

88. The combination of claim 84, said detector means comprising means to immediately operate said alarm means in the event gas concentration detected should at any time exceed a predetermined high limit.

89. The combination of claim 76, said detector comprising a built-in gas sensor and a remote sensor, switch means in said detector to permit signals from said built-in sensor to normally operate said detector, and said switch means including means to disable said built-in sensor when said remote sensor is put into operative cooperation with said detector.

90. The combination of claim 89, each of said sensors comprising a chemical based type device which responds to a plurality of different gases.

91. A gas detector comprising gas sensing means and alarm means, said detector comprising means for producing a signal corresponding to a predetermined limit of gas concentration, means to operate said alarm means when the gas sensed is above said predetermined limit, means to reset said detector between periods of operation, and means using said produced signal to immediately operate said alarm means in the event gas sensed should exceed said high limit during the re-setting operation.

92. The combination of claim 91, said alarm means operating means comprising a high limit comparator, and said produced signal comprising a reference voltage.

93. The combination of claim 91, said detector comprising means to store a signal corresponding to a sensed gas concentration, and means to cause said stored signal to operate said alarm means immediately after the re-setting operation is completed in the event said sensed gas concentration exceeds said predetermined value during the resetting operation.

94. The combination of claim 93, said signal storing means comprising a capacitor, means to isolate said capacitor during the re-setting operation, and said means to cause comprising a comparator which compares said stored signal to a signal corresponding to the current value of sensed gas concentration and which operates said alarm means when the result of said comparison exceeds a predetermined tolerance.

95. The combination of claim 91, said detector comprising electronic circuit means interconnecting said sensing means and said alarm means, said circuit means comprising memory means for storing a signal corresponding to a gas concentration detected by said sensing means, means to compare a previously stored signal to a current value of said signal, and means to operate said alarm means if the result of said comparison exceeds a predetermined tolerance.

96. The combination of claim 95, said alarm means comprising light means indicating that the detector is warmed up and ready to operate normally when steadily lit.

97. The combination of claim 95, said alarm means comprising light means indicating that the sensing means in said detector is faulty.

98. The combination of claim 95, said alarm means also comprising audio means which sound together with any of said light means.

99. The combination of claim 91, said predetermined limit comprising a predetermined high limit, and said detector means comprising means to operate said alarm means in the event gas concentration detected should in addition at any time exceed said predetermined high limit.

100. The combination of claim 91, said detector sensing means comprising a built-in gas sensor and a remote sensor, switch means in said detector to permit signals from said built-in sensor to normally operate said detector, and said switch means including means to disable said built-in sensor when said remote sensor is put into operative cooperation with said detector.

101. The combination of claim 100, each of said sensors comprising a chemical based type device which responds to a plurality of different gases.

102. In a gas detector comprising gas sensing means and alarm means, means to reset said detector between periods of operation, means to store a signal proportional to a sensed gas concentration, and means to cause said stored signal to operate said alarm means immediately after the re-setting operation is completed in the event said sensed gas concentration exceeds a predetermined value during the resetting operation.

103. The combination of claim 102, said signal storing means comprising a capacitor, means to isolate said capacitor during the re-setting operation, and said means to cause comprising a comparator which compares said stored signal to a signal corresponding to the current value of sensed gas concentration and which operates said alarm means when the result of said comparison exceeds a predetermined tolerance.

104. The combination of claim 102, said detector comprising electronic circuit means interconnecting said sensing means and said alarm means, said circuit means comprising memory means for storing a signal corresponding to a gas concentration detected by said sensing means, means to compare a previously stored signal to a current value of said signal, and means to operate said alarm means if the result of said comparison exceeds a predetermined tolerance.

105. The combination of claim 104, said alarm means comprising light means indicating that the detector is warmed up and ready to operate normally when steadily lit.

106. The combination of claim 104, said alarm means comprising light means indicating that the sensing means in said detector is faulty.

107. The combination of claim 104, said alarm means also comprising audio means which sound together with any of said light means.

108. The combination of claim 104, said detector means comprising means to immediately operate said alarm means in the event gas concentration detected should at any time exceed a predetermined high limit.

109. The combination of claim 102, said detector sensing means comprising a built-in gas sensor and a remote sensor, switch means in said detector to permit signals from said built-in sensor to normally operate said detector, and said switch means including means to disable said built-in sensor when said remote sensor is put into operative cooperation with said detector.

110. The combination of claim 109, each of said sensors comprising a chemical based type device which responds to a plurality of different gases.

111. A gas detector comprising gas sensing means and alarm means, electronic circuit means interconnecting said sensing means and said alarm means, said circuit means comprising memory means for storing a signal proportional to a gas concentration detected by said sensing means, means to compare a stored valve of said signal to a current value of said signal, and means to operate said alarm means if the result of said comparison exceeds a predetermined tolerance.

112. The combination of claim 111, said alarm means comprising light means indicating that the detector is warmed up and ready to operate normally when steadily lit.

113. The combination of claim 111, said alarm means comprising light means indicating that the sensing means in said detector is faulty.

114. The combination of claim 111, said alarm means also comprising audio means which sound together with any of said light means.

115. The combination of claim 111, said detector means comprising means to immediately operate said alarm means in the event gas concentration detected should at any time exceed a predetermined high limit.

116. The combination of claim 111, said detector sensing means comprising a built-in gas sensor and a remote sensor, switch means in said detector to permit signals from said built-in sensor to normally operate said detector, and said switch means including means to disable said built-in sensor when said remote sensor is put into operative cooperation with said detector.

117. The combination of claim 116, each of said sensors comprising a chemical based type device which responds to a plurality of different gases.

118. A gas detector comprising a built-in gas sensor and a remote sensor, switch means in said detector to permit signals from said built-in sensor to normally operate said detector, and said switch means including means to disable said built-in sensor when said remote sensor is put into operative cooperation with said detector.

119. The combination of claim 118, each of said sensors comprising a chemical based type device which responds to a plurality of different gases.

120. The method of operating a gas detector circuit which includes alarm means, and means including clock means to sample, track and store signals proportional to gas detected, comprising the steps of using said clock means to control the operation of said sample, track and store means, and causing said clock means to operate at least a portion of said alarm means in an alternating manner.

121. The method of claim 120, and the steps of sensing gas concentration, outputting a signal proportional thereto, said sample, track and store means comprising a feedback loop of a pair of amplifiers, inputting said signal corresponding to current gas concentration sensed as one input of one of said amplifiers, said second amplifier having a pair of inputs, inputting the output of said one amplifier together with an enable signal from said clock means as one of said inputs of said second amplifier, inputting an enable signal from said clock means together with a signal from said storage means corresponding to the previous stored signal corresponding to the input of said first amplifier as the second input to said second amplifier, causing said clock means to alternately activate the two inputs to said second amplifier, sensing the output of said second amplifier and causing said storage means to update itself thereto, comparing the output of said loop as a base line and the current signal, outputting a signal when the comparison result is greater than a predetermined gas presence and thereupon disabling the inputs of said clock means to said second amplifier, whereby said sample track and store means does not permit further base line updating after detection of said predetermined gas presence.

122. A gas detector alarm method which comprises the steps of using a plurality of different color light means, using a first color for indicating that a predetermined high limit of gas concentration has been detected, causing a first color and a second color to alternately blink for indicating a gas concentration less than said high limit but more than a predetermined lower value, and activating a third color alone to indicate that a gas concentration of at least said predetermined lower value was detected but has now dissipated.

123. The method of claim 122, and activating one of said colors alone and steadily for indicating that the detector is warmed up and ready to operate.

124. The method of claim 122, and activating a fourth color to indicate that sensing means in said detector is not operating properly.

125. The method of claim 124, wherein said first color is red, said second color is green, said third color is amber, and said fourth color is yellow.

126. The method of claim 122, and sounding audio means to accompany activation of any of said light means when said light means are activated to indicate an alarm.

127. The method of claim 126, wherein said first color is red, said second color is green, said third color is amber, and said audio means comprising a beeper which sounds in synchronism with said blinking colors.

128. The method of claim 122, activating said first color steadily to indicate said high limit, using a NOR gate and a diode so arranged in circuit with clock means that said clock means causes alternate activation of said first and second colors unless a high limit signal is present, and using said high limit signal to override said alternate activation to activate said first color steadily.

129. A method of operating a gas detector comprising an electronic circuit, sensor means for producing a signal proportional to gas concentration sensed and sample track and store means comprising clock means and memory means having a feedback loop, comprising the steps of tracking the gas concentration signal by periodically sampling said gas concentration signal, alternately inputting a stored signal and a current sample signal from said sensor means into said loop, using the output of said loop as the base line for the remainder of said circuit, and permitting only a change between said stored signal and said current sample signal of more than a predetermined tolerance to cause said base line to stop updating.

130. The method of claim 129, said detector comprising alarm means, and causing said base line to stop updating simultaneously with activatation of said alarm means.

131. The method of claim 129, performing said permitting step by continuously comparing the current gas sample signal and the latest base line signal, and setting said predetermined tolerance in said comparator.

132. The method of claim 129, operating said clock means on a one minute cycle, and tracking the gas signal for approximately 30 seconds of each cycle.

133. The method of claim 129, said tolerance comprising a predetermined increase in gas concentration occurring in less than a predetermined period of time.

134. The method of operating a gas detector using away alarm means to indicate that a predetermined gas condition has been detected and that the gas has now diminished to less than said predetermined condition.

135. The method of claim 134, and operating visual alarm means and audio alarm means simultaneously.

136. The method of claim 135, said audio alarm means comprising a beeper and causing said beeper to operate in an on/off mode.

137. A method of operating a gas detector comprising gas sensor means, alarm means, re-set means, and means for producing a signal corresponding to a predetermined limit of gas concentration, comprising the steps of operating said alarm means when the gas sensed is above said predetermined limit, and using said produced signal to immediately operate said alarm means in the event gas concentration sensed should exceed said high limit during a re-setting operation.

138. The combination of claim 137, said alarm means operating means comprising a high limit comparator, and said produced signal comprising a reference voltage.

139. A method of operating a gas detector comprising gas sensor means, alarm means and means to reset said detector between periods of operation, comprising the steps of storing a signal proportional to a sensed gas concentration, and causing said stored signal to operate said alarm means imediately after the re-setting operation is completed in the event said sensed gas concentration exceeds said predetermined value during the resetting operation.

140. The method of claim 139, said signal storing means comprising a capacitor, isolating said capacitor during the re-setting operation, and causing a comparator which compares said stored signal to a signal corresponding to the current value of sensed gas concentration to operate said alarm means when the result of said comparison exceeds a predetermined tolerance.

141. A method of operating a gas detector comprising gas sensing means and alarm means, comprising the steps of measuring gas concentration using said sensing means, using memory means to store a signal proportional to said measured concentration, comparing a stored value of said to a current value of said signal, and operating said alarm means if the result of said comparison exceeds a predetermined tolerance.

142. The method of claim 141, and the step of actuating light means steadily to indicate that the detector is warmed up and ready to operate normally.

143. The method of claim 141, and the step of activating light means to indicate that the sensing means in said detector is faulty.

144. The method of claim 141, and sounding audio means together with any of said light means.

145. The method of claim 141, and the step of immediately operating said alarm means in the event gas concentration detected should at any time exceed a predetermined high limit.

146. A method of operating a gas detector having a built-in gas sensor and a remote gas sensor, permitting signals from said built-in sensor to normally operate said detector, and disabling said built-in sensor when said remote sensor is put into operative cooperation with said detector.

147. The method of claim 146, each of said sensors comprising a chemical based type device which responds to a plurality of different gases.

* * * * *